US008820228B2

(12) United States Patent
Barrett

(10) Patent No.: US 8,820,228 B2
(45) Date of Patent: Sep. 2, 2014

(54) TOOL FOR USE IN MARKING A GOLF BALL

(71) Applicant: W. Raymond Barrett, St. Louis, MO (US)

(72) Inventor: W. Raymond Barrett, St. Louis, MO (US)

( * ) Notice: Subject to any disclaimer, the term of this patent is extended or adjusted under 35 U.S.C. 154(b) by 0 days.

(21) Appl. No.: 13/691,186

(22) Filed: Nov. 30, 2012

(65) Prior Publication Data

US 2013/0092036 A1 Apr. 18, 2013

Related U.S. Application Data

(63) Continuation-in-part of application No. 13/685,335, filed on Nov. 26, 2012, which is a continuation-in-part of application No. 29/431,250, filed on Sep. 5, 2012, now Pat. No. Des. 691,679, and a continuation-in-part of application No. 13/357,361, filed on Jan. 24, 2012, which is a continuation-in-part of application No. 29/388,964, filed on Apr. 5, 2011, now Pat. No. Des. 655,358.

(60) Provisional application No. 61/483,999, filed on May 9, 2011.

(51) Int. Cl.

| | |
|---|---|
| ***B41F 17/00*** | (2006.01) |
| ***A63B 37/00*** | (2006.01) |
| ***B41F 17/30*** | (2006.01) |
| ***A63B 45/02*** | (2006.01) |
| ***B43L 13/20*** | (2006.01) |

(52) U.S. Cl.

CPC ..... *B41F 17/30* (2013.01); *A63B 37/003* (2013.01); *A63B 45/02* (2013.01); *B43L 13/20* (2013.01)

USPC ..... 101/35; 101/114

(58) Field of Classification Search

USPC ..... 101/35, DIG. 40

See application file for complete search history.

(56) References Cited

U.S. PATENT DOCUMENTS

| | | | |
|---|---|---|---|
| 109,204 | A | 11/1870 | Hartz |
| D5,556 | S | 2/1872 | Pettengill |
| D20,187 | S | 10/1890 | Herrick |
| D27,441 | S | 7/1897 | Dunn |
| 676,506 | A | 6/1901 | Knight et al. |

(Continued)

FOREIGN PATENT DOCUMENTS

| | | |
|---|---|---|
| CN | D300788288 | 6/2008 |
| CN | D300897422 | 3/2009 |

(Continued)

OTHER PUBLICATIONS

Taylor Made Golf, "Easy-To-See Alignment Lines", <http://www.taylormadegolf.com/products/putters/Ghost-Series-putter/product-detail-technology/params/easy-to-see-alignment-line-technology>, dated May 5, 2011, 2 pages.

(Continued)

*Primary Examiner* — Anthony Nguyen

(74) *Attorney, Agent, or Firm* — Senniger Powers LLP

(57) ABSTRACT

A tool for use in marking a golf ball includes a body having a curved portion configured to receive a golf ball and extend along a portion of an outer surface of the golf ball. The body includes at least one track extending along the curved portion. Each track includes an aperture adapted to receive a writing instrument to permit marking of the golf ball through the aperture.

20 Claims, 4 Drawing Sheets

(56) References Cited

U.S. PATENT DOCUMENTS

| | | | | |
|---|---|---|---|---|
| D55,413 | S | 6/1920 | Cigol | |
| D61,805 | S | 1/1923 | Griffiths | |
| D61,806 | S | 1/1923 | Griffiths | |
| D141,546 | S | 6/1945 | Glass | |
| 2,707,595 | A | 5/1955 | Brown | |
| 2,709,595 | A | 5/1955 | De Vries | |
| 3,318,598 | A | 5/1967 | Ruskin | |
| 3,829,348 | A | 8/1974 | Spiegel et al. | |
| 3,835,545 | A * | 9/1974 | Taylor | 33/510 |
| 4,209,172 | A | 6/1980 | Yamamoto | |
| 4,235,441 | A | 11/1980 | Ciccarello | |
| 4,244,470 | A * | 1/1981 | Burnham | 206/525 |
| 4,258,921 | A | 3/1981 | Worst | |
| 4,266,773 | A | 5/1981 | Treadwell | |
| 4,284,276 | A * | 8/1981 | Worst | 473/383 |
| 4,603,862 | A | 8/1986 | Chen | |
| 4,741,535 | A | 5/1988 | Leonhardt | |
| 4,991,838 | A | 2/1991 | Groves | |
| 5,004,239 | A * | 4/1991 | Wettstein | 473/282 |
| 5,133,556 | A | 7/1992 | Karasavas | |
| D329,485 | S | 9/1992 | Hollinger | |
| 5,427,378 | A | 6/1995 | Murphy | |
| 5,437,446 | A | 8/1995 | Youngkin | |
| 5,439,224 | A | 8/1995 | Bertoncino | |
| D369,192 | S | 4/1996 | Imswiler | |
| D370,705 | S | 6/1996 | Cullen, III | |
| 5,564,707 | A | 10/1996 | Dinh | |
| 5,662,530 | A | 9/1997 | Sellar | |
| 5,713,799 | A | 2/1998 | Balmat | |
| D408,481 | S | 4/1999 | Disco | |
| D411,599 | S | 6/1999 | Sullivan | |
| D414,229 | S | 9/1999 | Sohn | |
| D415,541 | S | 10/1999 | Stahl et al. | |
| D417,477 | S | 12/1999 | Sullivan | |
| 6,004,223 | A * | 12/1999 | Newcomb | 473/257 |
| 6,213,012 | B1 | 4/2001 | Arms | |
| 6,231,459 | B1 | 5/2001 | Pettigrew et al. | |
| 6,324,971 | B1 * | 12/2001 | Urban | 101/35 |
| D458,978 | S | 6/2002 | Lombardi | |
| 6,422,949 | B1 | 7/2002 | Byrne et al. | |
| 6,453,807 | B1 | 9/2002 | Ramey | |
| 6,595,128 | B2 * | 7/2003 | Parks | 101/127 |
| D487,911 | S | 3/2004 | Cheney | |
| D523,100 | S | 6/2006 | Sano | |
| 7,223,178 | B2 | 5/2007 | Henry | |
| D544,930 | S | 6/2007 | Farrell | |
| 7,371,186 | B2 * | 5/2008 | Rutherford | 473/257 |
| 7,691,005 | B2 | 4/2010 | Mitsuba | |
| D627,020 | S | 11/2010 | Martin | |
| 7,963,869 | B2 | 6/2011 | Boyer et al. | |
| D655,358 | S | 3/2012 | Barrett | |
| D669,550 | S | 10/2012 | Nelson | |
| 8,403,768 | B2 | 3/2013 | Aittola | |
| 2002/0002086 | A1 | 1/2002 | Inoue et al. | |
| 2003/0144068 | A1 | 7/2003 | Yang | |
| 2004/0220001 | A1 | 11/2004 | Oister et al. | |
| 2005/0170920 | A1 | 8/2005 | Boyer et al. | |
| 2006/0293113 | A1 * | 12/2006 | Pelz | 473/280 |
| 2007/0084095 | A1 | 4/2007 | Wellington | |
| 2007/0197309 | A1 * | 8/2007 | Geraty | 473/257 |
| 2007/0245910 | A1 * | 10/2007 | Hung | 101/35 |
| 2008/0096691 | A1 | 4/2008 | Kang | |
| 2008/0305880 | A1 | 12/2008 | Brown | |
| 2010/0095858 | A1 * | 4/2010 | Krikorian | 101/35 |
| 2011/0207553 | A1 | 8/2011 | Reid et al. | |
| 2012/0028726 | A1 | 2/2012 | Aittola | |
| 2012/0258815 | A1 | 10/2012 | Barrett | |

FOREIGN PATENT DOCUMENTS

| | | |
|---|---|---|
| CN | 301968362 | 6/2012 |
| GB | D2043359 | 1/1996 |
| GB | D2051948 | 1/1996 |
| GB | D2077843 | 2/1999 |
| WO | 00/67853 | 11/2000 |
| WO | D071271-022 | 1/2009 |
| WO | 2012/138598 A2 | 10/2012 |

OTHER PUBLICATIONS

Ping, "Easy Alignment", <http://www.ping.com/clubs/puttersdetail.aspx?id=8499&tid=515>, dated May 5, 2011, 1 page.

Scotty Cameron, "Studio Select® Squareback 1", <http://www.scottycameron.com/putters/puttermodel.aspx?id=386>, dated May 5, 2011, 1 page.

Scotty Cameron, "Studio Select® Fastback 1.5", <http://www.scottycameron.com/putters/puttermodel.aspx?id=385>, dated May 5, 2011, 1 page.

Edel Golf (http://edelgolf.com), Edel Golf and AimPoint Technologies Form Strategic Partnership, Press Release, pp. 1-2, Jan. 28, 2010, Austin, Texas (http://edelgolf.com/index.php?option=com_content&task=article&id=22&Itemid=14&j=nsw).

Sayim, Bilge et al., Contrast polarity, chromaticity, and stereoscopic depth modulate contextual interactions in vernier acuity, Journal of Vision, http://jov.journalofvision.org/8/8/12/article.aspx, Feb. 9, 2011, 15 pages.

D.W. Quail Golf, In-Line Golf Ball Line Marking Kit, http://www.dwquailgolf.com/training/inline.html, Jun. 29, 2011, 2 pages.

Golfer's Avenue, Golf Putting Aids, http://www.golfersavenue.com/golf-putting-aids.html, Jun. 27, 2011, 2 pages.

Westheimer, G., Visual Acuity, in Moses RA, Hart WM, editor. Chapter 7 of Adler's Physiology of the Eye, Ninth Edition, Clinical application St. Louis, Missouri: The C.V. Mosby Company, 1987, 19 pages.

Striped Table Tennis Ball shown on webpage: http://www.activinstinct.com/table-tennis/balls/adidas-stripes-table-tennis-ballbox-of-6/# Retrieved on Aug. 21, 2010, 1 page.

Westheimer, G., Visual acuity and spatial modulation thresholds. In: Jameson D., Hurvich LM, editor. Handbook of sensory physiology. Visual psychophysics. vol. 7. Berlin: Springer-Verlag; 1972, pt. 4, pp. 170-187.

* cited by examiner

TOOL FOR USE IN MARKING A GOLF BALL

This application is a continuation-in-part of U.S. patent application Ser. No. 13/685,335 filed Nov. 26, 2012 entitled Golf Ball with Indicia for Alignment, which is a continuation-in-part of U.S. Design patent application No. 29/431,250 filed Sep. 5, 2012 entitled Golf Ball Having Three Colored Parallel Lines, and a continuation-in-part of U.S. patent application Ser. No. 13/357,361 filed Jan. 24, 2012, entitled Golf Ball with Indicia for Alignment, which is a nonprovisional of U.S. Provisional Patent Application Ser. No. 61/483,999 filed May 9, 2011, entitled Golf Ball with Indicia for Alignment, and a continuation-in-part of U.S. Design patent application Ser. No. 29/388,964 filed Apr. 5, 2011 and issued as U.S. Pat. No. D655,358 on Mar. 6, 2012, the entire disclosures of which is incorporated herein by reference.

FIELD OF THE INVENTION

The present invention generally relates to golf balls, and more particularly to a golf ball marking tool.

BACKGROUND OF THE INVENTION

Golfers often have difficulty properly aligning a putter club head with a golf ball along an intended direction of ball travel and accurately stroking the putter club head through the ball along the intended direction. If the putter is aligned and strikes the ball true, it will follow the laws of physics and move in the direction struck. It is critical to not only strike the center of the ball with the center of gravity of the putter, but also at the correct angle. Using the tangent formula, for every one degree of deviation from a perpendicular, a strike of the ball will be deviated approximately 0.209 inches per foot of travel. For a ten foot putt, this translates to 2.09 inches. Thus, performance can be improved by improving the alignment of the putter with the ball.

Vernier acuity in visual psychophysics refers to the process of identifying offset in parallel lines or dots. It is known that humans are remarkably adept at performing a vernier acuity task. Thresholds of vernier acuity are on the order of detecting approximately 10-30 seconds of arc. This threshold is approximately ten times better than any other type of acuity task, such as recognition acuity. Accordingly, a putting system that incorporates a vernier acuity task will assist the user in aligning a putt.

The contents of the following are herein incorporated by reference: *How Vernier Acuity Depends on Contrast, Experimental Brain Research*, C. Wehrhahn & G. Westheimer (1990); *Sensation and Perception*, J. M. Wolfe, K. Kluender, D. M. Levi, L. M. Bartoshuk, R. Herz, & R. Klatzky (2008); *Temporal and Spatial Interference with Vernier Acuity, Vision Research*, G. Westheimer & G. Hauske (1975); *Development of VEP Vernier Acuity and Grating Acuity in Human Infants, Invest Ophthalmol Vis. Sci.*, Skoczenski & Norcia (September 1999); *Contrast Polarity, Chromaticity, and Stereoscopic Depth Modulate Contextual Interactions in Vernier Acuity, Journal of Vision*, B. Sayim, G. Westheimer & M. Herzog (2008); *Visual Acuity and Spacial Modulation Thresholds, Handbook of Sensory Physiology Vol.* 7, G. Westheimer (1972); and *Visual Acuity, Adler's Physiology of the Eye*, G. Westheimer (1987).

SUMMARY OF THE INVENTION

A marking tool for use in marking a golf ball includes a body having a curved portion configured to receive a golf ball and extend along a portion of an outer surface of the golf ball. The body includes at least one track extending along the curved portion. Each track includes an aperture adapted to receive a writing instrument to permit marking of the golf ball through the aperture.

A kit for marking a golf ball includes a first marking tool and a second marking tool. Each of the first and second marking tools includes a body having a curved portion configured to receive a golf ball and extend along a portion of an outer surface of the golf ball. The body includes an engagement structure. The body further includes at least one track extending along the curved portion. Each track includes an aperture adapted to receive a writing instrument to permit marking of the golf ball through the aperture. The engagement structure of the first marking tool is configured to engage the engagement structure of the second marking tool, such that the first and second marking tools are selectively and releasably attachable to each other.

A method of marking a golf ball with indicia for improving alignment includes placing a first marking tool on the golf ball, such that a portion of the outer surface of the golf ball is received in a curved portion of the first marking tool. A second marking tool is placed on the golf ball opposite the first marking tool. The first marking tool is secured to the second marking tool by engaging an engagement structure on the first marking tool with an engagement structure on the second marking tool. The golf ball is marked with a writing instrument through apertures on the first and second marking tools.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

In one form, the invention comprises a golf ball marking tool allowing a golfer to mark a golf ball with indicia for visibility and alignment of the golf ball with an intended direction of travel.

Figure 1:
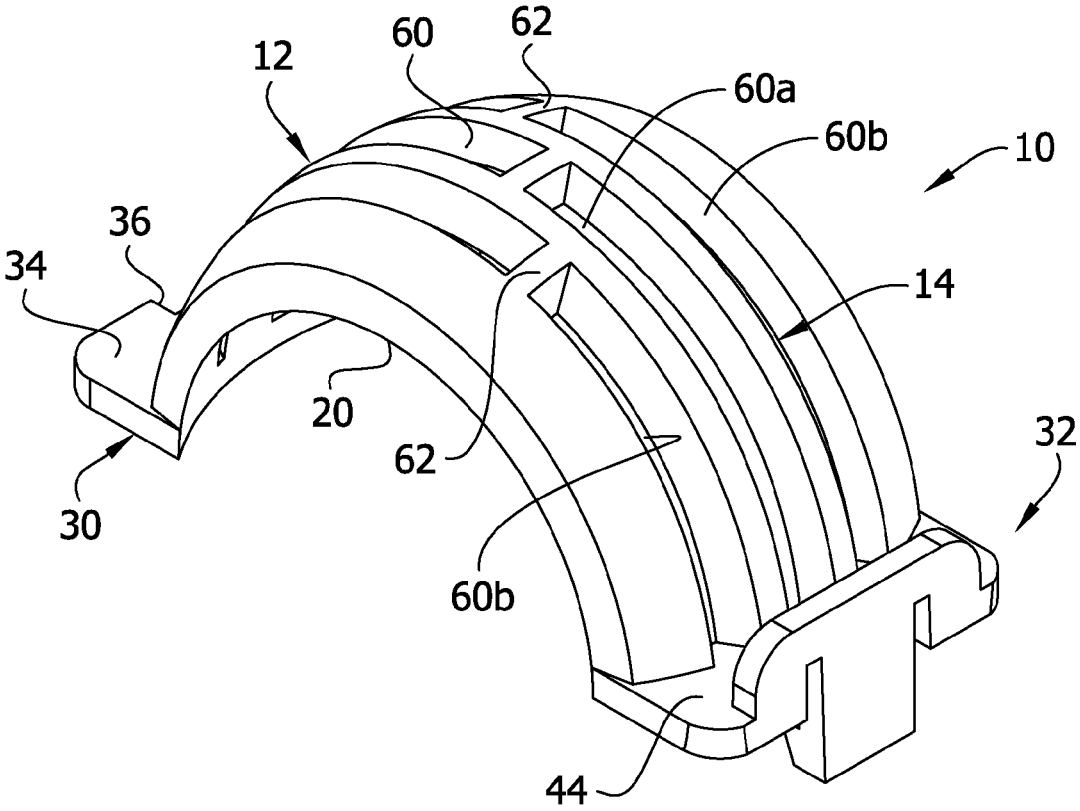
FIG. 1 is a top perspective view of a golf ball marking tool according to the present invention.
Figure 2:
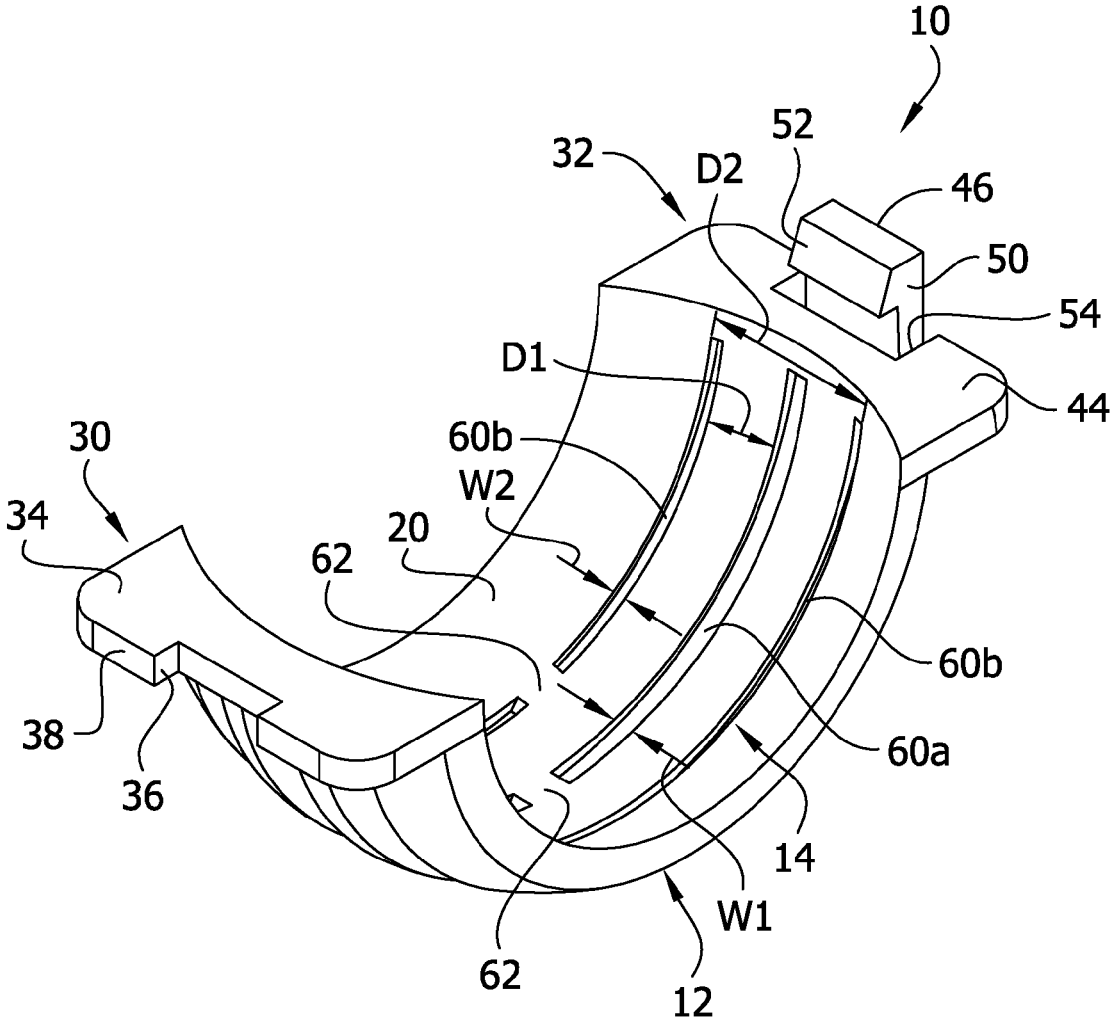
FIG. 2 is a bottom perspective view thereof.

Referring to FIGS. 1 and 2, a golf ball marking tool is generally designated by the reference number 10. The golf ball marking tool 10 includes a body, generally indicated at 12, and marking guides generally indicated at 14, which allows a user to mark a golf ball to improve accuracy in alignment of the ball, as described below.

Figure 3:
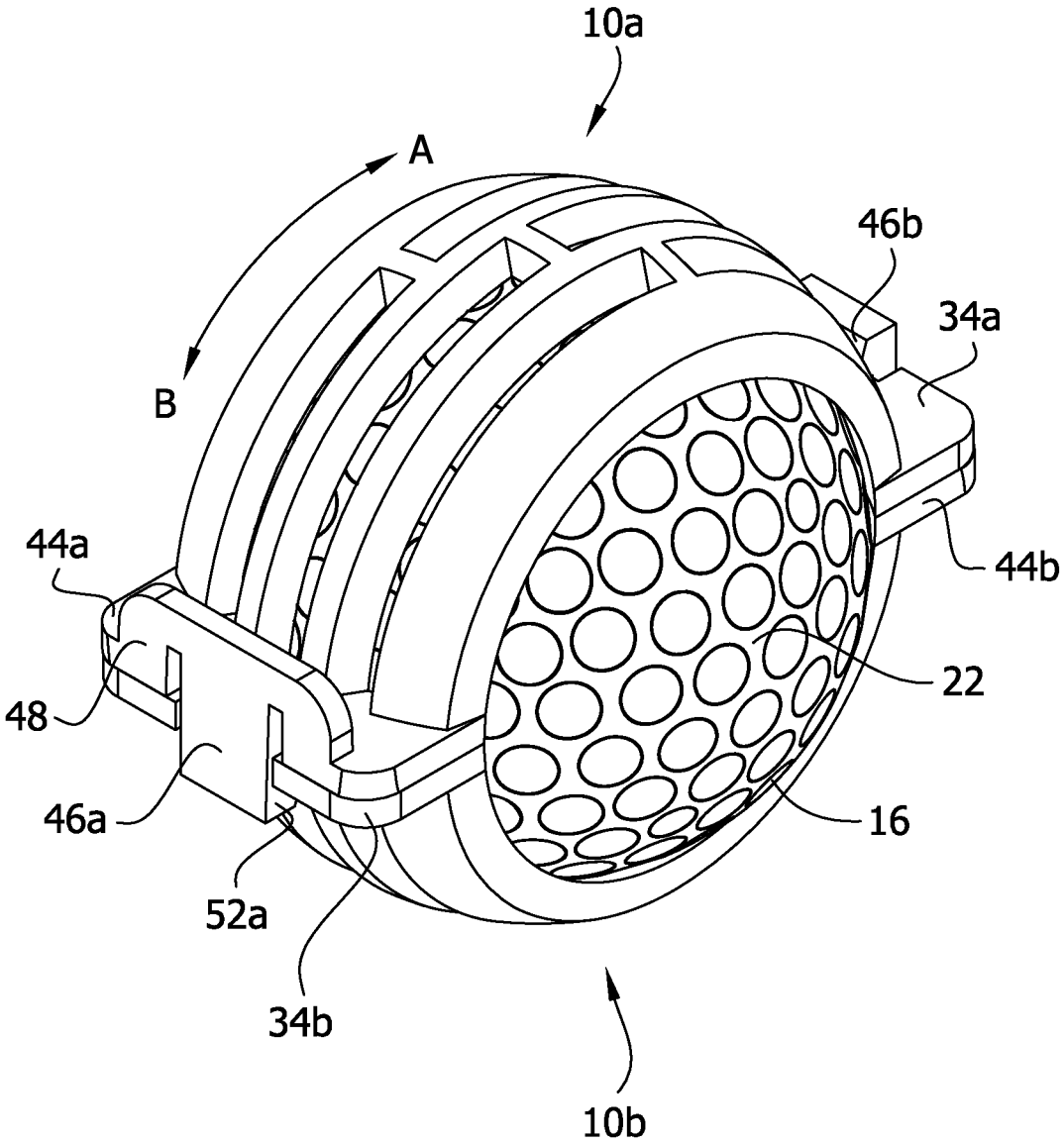
FIG. 3 is a perspective of a golf ball received in a pair of golf ball marking tools according to the present invention.
Figure 4:
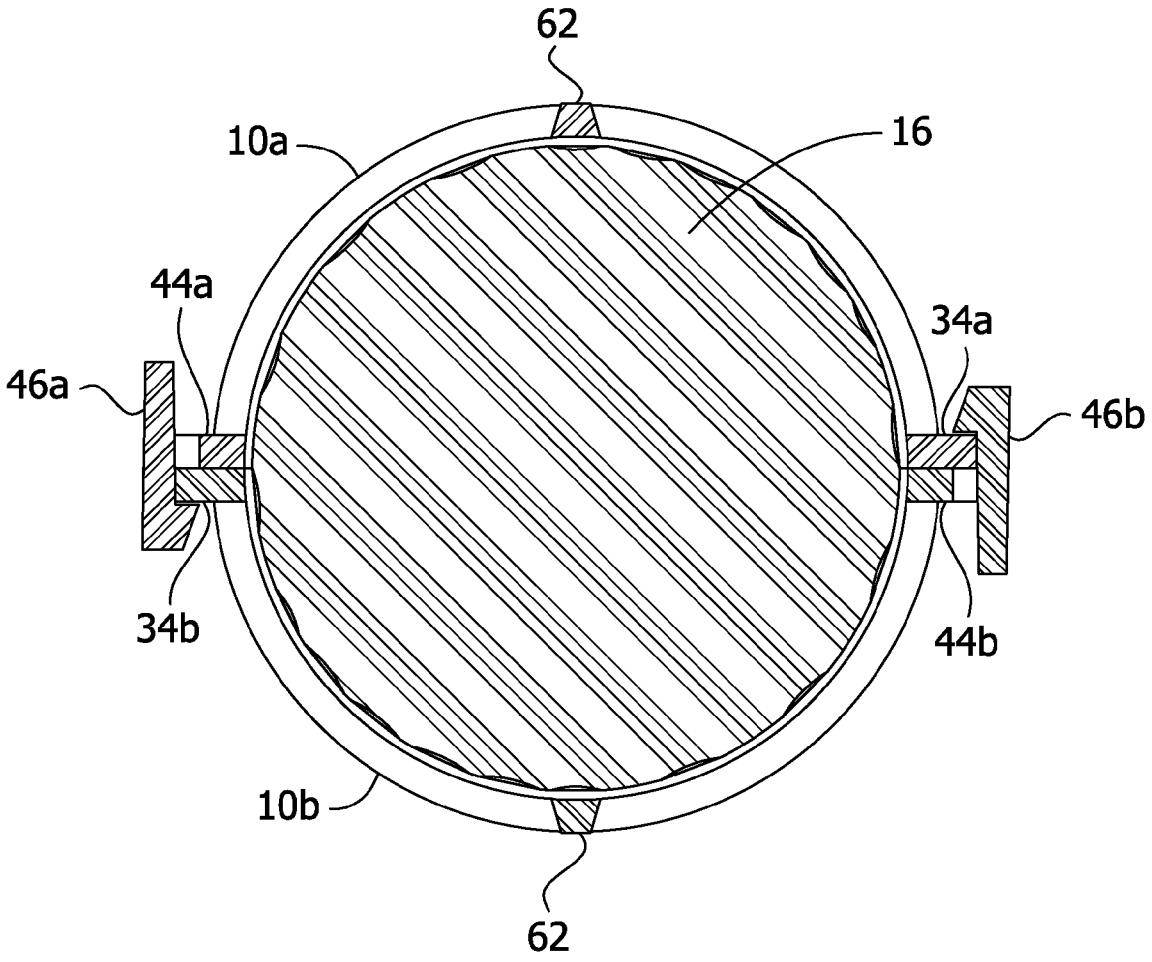
FIG. 4 is a cross section illustrating the engagement of the marking tools of FIG. 3.

The body 12 of the golf ball marking tool 10 is configured to receive a golf ball 16 (see FIGS. 3 and 4). The body 12 includes a curved portion 20 configured to receive at least a portion of the golf ball 16 such that the curved portion extends over part of the outer surface 22 of the golf ball. In the illustrated embodiment, the curved portion 20 extends 180 degrees along the curvature of one hemisphere of the golf ball 16. The curved portion 20 may be configured to extend along a greater portion of the golf ball or a lesser portion of the golf ball without departing from the scope of the present invention. The golf ball 16 may be a typical golf ball, preferably having a diameter of approximately 1.68 inches or greater, since United States Golf Association Rules dictate such a diameter for the golf ball. As seen in FIG. 3, the curved portion 20 conforms to the outer surface of the golf ball 16. In some embodiments, the curved portion 20 is configured such that the golf ball 16 received in the curved portion can be rotated relative to the marking tool 10. In some embodiments, the curved portion 20 may fit tightly to the golf ball 16 such that the golf ball cannot be rotated relative to the marking tool 10.

Because the body 12 is configured to receive the golf ball 16, little to no flexure is required to place the body on the ball. Thus, strong materials with little flexibility can be used to make the tool 10. The marking tool 10 can be made of plastic, such as a lower viscosity or high flow plastic. Suitable plastics include AGS, nylon, high flow polycarbonate, or other plastics known in the art. Preferably, the marking tool 10 is made by injection molding a tough plastic, such as those listed. The marking tool 10 should be durable enough to be kept in a user's golf bag without need for a protective case.

At opposing ends of the curved portion 20, the body 12 includes first and second finger flanges or end portions 30, 32. The first and second end portions 30, 32 provide a holding area for a user to grip the marking tool 10. The end portions 30, 32 also include an engagement structure for releasably attaching the tool 10 to a second tool 10 of similar or identical construction, as will be described below. In the illustrated embodiment, the first end portion 30 includes a flat base 34 extending radially outward from the curved portion 20. The engagement structure on the first end portion 30 includes a notch 36 on the flat base 34 configured for attachment to a second marking tool 10, as will be described below. The notch 36 is positioned in the middle of the flat base 34 and extends inwardly from an outer edge surface 38 of the flat base. The second end portion 32 includes a flat base 44 extending radially outward from the curved portion 20 opposite the first end portion 30. The engagement structure on the second end portion 32 includes a latch 46 configured for attachment to a second marking tool 10, as will be described below. The latch 46 extends from a grip or flange 48 that extends perpendicularly from the flat base 44. The latch 46 includes an arm 50 connected to and extending from the flange 48, and a hook or barb 52 projecting from the arm near a free end of the arm. The arm 50 is connected to the flange 48 such that the arm can flex radially in and out relative to the flange. The flat base 44 can include a cut-out 54 corresponding to the location of the barb 52 to simplify the molding process if the tool 10 is injection molded from a plastic.

The body 12 of the tool 10 further includes marking guides 14 comprising a plurality of marking openings or tracks 60 at spaced intervals. Each track 60 comprises a slot or aperture configured to receive a marking tool such as a pen, marker, or other writing instrument. In the illustrated embodiment, the curved portion 20 includes three tracks 60 extending along the curvature of the curved portion.

In one embodiment, the three tracks 60 can extend along about one third golf ball to facilitate marking that third of the golf ball with a writing instrument. In another embodiment, the three tracks 60 can extend along about one sixth (60 degrees) of the golf ball to facilitate marking about 60 degrees of the golf ball with a writing instrument, although tracks and markings of less than one sixth are contemplated. Each track 60 can include a bridge or reinforcing rib 62 extending transversely across the track at a location along the track. In the illustrated embodiment, the ribs 62 are staggered such that each rib is out of alignment with the ribs of the other tracks 60. The ribs 62 provide structural stability to the tool 10. It is understood that the ribs may have other configurations or may be omitted entirely within the scope of the present invention.

The marking tool 10 is preferably configured to allow a user to mark a golf ball with indicia as disclosed in the co-owned U.S. application Ser. No. 13/357,361, the entirety of which is incorporated herein by reference. Specifically, the marking tool 10 is preferably configured to facilitate marking a golf ball with indicia that improves vernier acuity, thereby allowing a golfer to more accurately align the golf ball with a target. Preferably the tracks 60 are configured to be located more or less within the center third of the golf ball 16. The inner or central track 60*a* extends along the center of the curved portion 20 such that the inner track 60*a* will be located at the equator or center of the golf ball 16 when the golf ball is received in the tool 10. The two outer tracks 60*b* flank the inner track 60*a* and are parallel to the inner track and to each other. In one embodiment, the three tracks 60 are configured to extend along approximately one third of a golf ball received in the tool 10 to permit a user to mark the golf ball with indicia extending along one third of the curvature of the golf ball. It is within the scope of the present invention that the marking tool 10 includes a different number or configuration of tracks.

The inner track 60*a* has a width W1, which is preferably in a range of about 0.03125 (1/32) inches to 0.09375 (3/32) inches, and in one embodiment is about 0.0625 (1/16) inches. In another embodiment, the width W1 is about 0.03937 inches (1 mm). The outer tracks 60*b* each have a width W2, which is preferably in a range of about 0.015625 (1/64) inches to 0.0625 (1/16) inches, and in one embodiment is about 0.03125 (1/32) inches. In another embodiment, the width W2 is about 0.01969 inches (0.5 mm). Other configurations of the inner and outer tracks, such as all three tracks having the same width or all three tracks having different widths, are within the scope of the present invention. The widths W1, W2 of the tracks permit lines of that width to be marked on the golf ball.

The outer tracks 60*b* are spaced a distance D1 from the inner track 60*a*. To improve vernier acuity, D1 is preferably at least about 0.114 inches. In one embodiment, each outer track 60*b* is spaced the same distance D1 from the inner track 60*a*; however, other configurations are within the scope of the present invention. The distance D1 is preferably in a range of about 0.125 (1/8) inches to 0.3125 (5/16) inches, and in one embodiment is about 0.21875 (7/32) inches. In another embodiment, the distance D1 is about 0.25 (1/4) inches.

The parallel tracks 60 span a distance D2 across the body 12, and therefore across the golf ball 16. The distance D2 is preferably in a range of about 25%-50% of the diameter of the golf ball, and more preferably is in a range of about 30%-35% of the diameter of the ball. If the golf ball 16 has a diameter of 1.68 inches, as discussed above, the distance D2 is preferably in a range of about 0.42 inches to 0.84 inches, and more preferably is in a range of about 0.504 inches to 0.588 inches. In one embodiment, the distance D2 is about 0.5625 (9/16) inches. In another embodiment, the distance D2 is about 0.625 (5/8) inches. In still another embodiment, the distance D2 is about 0.5787 inches.

The marking tool 10 is configured to be releasably attached to a second marking tool of similar or identical construction. As seen in FIGS. 3 and 4, the latch 46 of one marking tool 10*a* is configured to engage with the notch 36 of a second marking tool 10*b*. The first and second marking tools 10*a*, 10*b* are constructed as described above. The barb 52*a* of the latch 46*a* of the first marking tool 10*a* extends into the notch 36*b* of the second marking tool 10*b* and engages the flat base 34*b*. Likewise, the barb 52*b* of the latch 46*b* of the second marking tool

10*b* extends into the notch 36*a* of the first marking tool 10*a* and engages the flat base 34*a*. In order to detach the marking tools 10 from each other, a user can pull on the latches 46 to disengage the latches from the notches 36.

In accordance with one embodiment of the present invention, a user can use a single marking tool to mark a golf ball with indicia to improve alignment of the golf ball during use. In another embodiment, a user can use a pair of marking tools to mark a golf ball with indicia to improve alignment of the golf ball during use. First, the user inserts the golf ball 16 into a first marking tool 10*a* such that the curved portion 20*a* receives an outer surface 22 of the golf ball. Then, the user attaches a second marking tool 10*b* to the first marking tool 10*a* by engaging the latches and notches of the marking tools as described above. Thus, the golf ball 16 is received between the two marking tools 10*a*, 10*b*, which extend generally around the equator or center of the golf ball. Once the marking tools 10*a*, 10*b* are secured around the golf ball 16, the user can mark the golf ball by inserting a writing instrument into the tracks 60 on the marking tools to mark the golf ball with indicia. The user can rotate the golf ball 16 in a direction A or B parallel to the curvature of the curved portions 20 or the marking tools 10 to ensure that the indicia extends around the entirety of the golf ball, if desired. Alternatively, the user may choose not to rotate the golf ball or to only mark a portion of the golf ball, e.g. one third of the golf ball. The user may use different writing instruments to mark in each of the tracks 60 so that the resulting indicia on the golf ball 16 contrasts to increase vernier acuity. For example, the user can use one color to mark the outer tracks and a different color to mark the inner tracks. In one example, to increase vernier acuity, a user may use a red writing instrument configured to mark the golf ball through the inner track 60*a* and a blue writing instrument configured to mark the golf ball through each of the outer tracks 60*b*. Thus, in this example, the golf ball 16 is marked with three parallel lines (e.g., arcs), wherein the center line is red and the outer lines are blue. Other colors and marking patterns can be used within the scope of the present invention (e.g., three parallel circles). Once the golf ball 16 is marked with indicia, the user can remove the marking tools 10 from the golf ball by pulling on the latches 46 to release them from the notches 36. It is understood that the user may use only one marking tool 10 to mark the golf ball in the manner described above, either by marking only a portion of the golf ball or by rotating the golf ball within the marking tool to mark the entirety of the golf ball.

In one embodiment, a kit includes two marking tools 10 of identical construction. The kit can also include writing instruments suitable for use in marking a golf ball through the tracks 60 of the marking tools 10. Optionally, the kit can include a golf ball or a plurality of golf balls for use with the marking tools 10.

It is understood that a single marking tool 10 can be used for marking a golf ball without a second marking tool within the scope of the present invention. A golf ball 16 can be received in the curved portion 20 of the marking tool 10, and then rotated to permit marking around the entirety of the golf ball, if desired. Alternatively, the user can choose not to rotate the golf ball 16 within the marking tool 10 so that only a portion of the golf ball is marked. For example, a user may choose on only mark one third of the curvature of the golf ball.

The marking tool 10 permits a user to mark a golf ball 16 with indicia that allows the user to align the ball and improve accuracy in putting. The characteristics of the tracks 60 discussed above, such as the width of the tracks 60*a*, 60*b*, the distance between the tracks, and the span of the tracks, permit a user to mark a golf ball with indicia that optimizes the user's ability to perform a vernier acuity task and align the marked golf ball with a target.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the invention by way of example and not by way of limitation. This description enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A marking tool for use in marking a golf ball, the marking tool comprising:

a body having a curved portion configured to receive a golf ball and extend along a portion of an outer surface of the golf ball, the body including three parallel tracks extending along the curved portion of the body, each track comprising an aperture adapted to receive a writing instrument to permit marking of the golf ball through the aperture.

2. The marking tool of claim 1, wherein the body further includes a latch at a first end of the body and a notch at a second end of the body opposite the first end.

3. The marking tool of claim 2, wherein the latch is configured to engage a notch of a second marking tool of identical construction.

4. The marking tool of claim 1, further comprising a flange at a first end of the body configured to permit a user to grip the marking tool.

5. The marking tool of claim 1, wherein each of the three parallel tracks includes a reinforcing rib extending transversely across the track.

6. The marking tool of claim 5, wherein each reinforcing rib is staggered from the reinforcing ribs of the other tracks.

7. The marking tool of claim 1 including one of the following:

wherein the tracks span a total distance of at least one-sixth of a golf ball;

wherein the tracks span a total distance of 0.5625 inches;

wherein the tracks span a total distance of 0.5787 inches; and wherein the tracks span a total distance of 0.625 inches.

8. The marking tool of claim 1 wherein the three parallel tracks comprise an inner track extending along a center of the curved portion and two outer tracks flanking the inner track, and further comprising a red writing instrument configured for marking the golf ball through the inner track and a blue writing instrument configured for marking the golf ball through each of the two outer tracks.

9. The marking tool of claim 1, wherein the three parallel tracks comprise an inner track extending along a center of the curved portion and two outer tracks flanking the inner track presenting an image for a vernier acuity task.

10. The marking tool of claim 9, wherein the inner track has a width of 0.0625 inches, and wherein each of the two outer tracks has a width of 0.03125 inches.

11. The marking tool of claim 9, wherein the inner track has a width of 0.03937 inches (1 mm), and wherein each of the two outer tracks has a width of 0.01969 inches (0.5 mm).

12. The marking tool of claim 9 including one of the following:

wherein each of the two outer tracks is spaced a distance of at least 0.114 inches from the inner track; and wherein each of the two outer tracks is spaced a distance of 0.25 inches from the inner track.

13. A kit for marking a golf ball, the kit comprising:

a first marking tool; and a second marking tool, wherein each of the first and second marking tools comprises:

a body having a curved portion configured to receive a golf ball and extend along a portion of an outer surface of the golf ball, the body including an engagement structure and three parallel tracks extending along the curved portion, each track comprising an aperture adapted to receive a writing instrument to permit marking of the golf ball through the aperture, the engagement structure of the first marking tool being configured to engage the engagement structure of the second marking tool, such that the first and second marking tools are selectively and releasably attachable to each other.

14. The kit of claim 13, wherein the three parallel tracks comprise an inner track extending along a center of the curved portion and two outer tracks flanking the inner track, and further comprising a red writing instrument configured for marking the golf ball through the inner track and a blue writing instrument configured for marking the golf ball through each of the two outer tracks.

15. A method of marking a golf ball with indicia for improving alignment, the method comprising:

placing a first marking tool having three parallel tracks on the golf ball, such that a portion of the outer surface of the golf ball is received in a curved portion of the first marking tool; and marking the golf ball with a writing instrument through apertures on the first marking tool to add red and blue parallel lines on the golf ball.

16. A method according to claim 15, wherein marking the golf ball comprises marking the golf ball with a first color through an inner aperture on the first marking tool and marking the golf ball with a second color through a pair of outer apertures on the first marking tool.

17. The method of claim 16 wherein the first color is red and the second color is blue.

18. The marking tool of claim 1 wherein the three parallel tracks comprise two outer tracks and an inner track located between the two outer tracks, wherein the aperture of each of the two outer tracks has a width smaller than a width of the aperture of the inner track.

19. The marking tool of claim 18 wherein the three parallel tracks span a total distance in a range of about 0.42 inches to about 0.84 inches.

20. A method according to claim 15, further comprising placing a second marking tool on the golf ball opposite the first marking tool and securing the first marking tool to the second marking tool by engaging an engagement structure on the first marking tool with an engagement structure on the second marking tool, wherein marking the golf ball comprises marking the golf ball with a writing instrument through apertures on the first and second marking tools.

* * * * *